US008448449B2

(12) United States Patent
Carlisle

(10) Patent No.: US 8,448,449 B2
(45) Date of Patent: May 28, 2013

(54) FUEL INJECTOR MOUNTING SYSTEM

(75) Inventor: Michael L. Carlisle, Derby (GB)

(73) Assignee: Rolls-Royce PLC, London (GB)

( * ) Notice: Subject to any disclaimer, the term of this patent is extended or adjusted under 35 U.S.C. 154(b) by 495 days.

(21) Appl. No.: 12/883,590

(22) Filed: Sep. 16, 2010

(65) Prior Publication Data

US 2011/0088407 A1 Apr. 21, 2011

(30) Foreign Application Priority Data

Oct. 16, 2009 (GB) ..... 0918099.3

(51) Int. Cl.
*F02C 7/20* (2006.01)

(52) U.S. Cl.
USPC ..... 60/796; 60/740

(58) Field of Classification Search
USPC ..... 60/740, 796–800; 239/283, 390, 239/397, 600
See application file for complete search history.

(56) References Cited

U.S. PATENT DOCUMENTS 2,422,214 A * 6/1947 Meyer et al. ..... 60/740
3,398,529 A * 8/1968 Schmitz et al. ..... 60/796
4,441,323 A * 4/1984 Colley ..... 60/737
4,466,240 A * 8/1984 Miller ..... 60/796
5,031,407 A * 7/1991 Zaremba et al. ..... 60/739
5,197,288 A * 3/1993 Newland et al. ..... 60/734
5,305,609 A * 4/1994 Guinan et al. ..... 60/740
5,771,696 A * 6/1998 Hansel et al. ..... 60/739
5,816,041 A * 10/1998 Greninger ..... 60/775
6,553,769 B2 * 4/2003 Halila et al. ..... 60/772
7,669,424 B2 * 3/2010 Thornton ..... 60/796
2007/0033940 A1 * 2/2007 Duverneuil et al. ..... 60/743
2007/0137218 A1 6/2007 Prociw et al.
2010/0115955 A1 * 5/2010 Goeke et al. ..... 60/740

OTHER PUBLICATIONS

British Search Report dated Feb. 10, 2010 issued in British Patent Application No. 0918099.3.

* cited by examiner

*Primary Examiner* — Phutthiwat Wongwian
(74) *Attorney, Agent, or Firm* — Oliff & Berridge, PLC

(57) ABSTRACT

A system is provided for mounting fuel injectors to a gas turbine engine. The system comprises an engine casing having a plurality of apertures formed therein. The system further comprises a plurality of first and second fuel injectors. Each fuel injector has a respective flange for mounting the fuel injector to the casing at a respective aperture so that the fuel injector extends into the engine. The first fuel injectors have flanges which are dismountably sealed to an inner side of the casing. The second fuel injectors have flanges which are dismountably sealed to an outer side of the casing. The flanges of the first fuel injectors are configured to allow them to pass through the apertures of the second fuel injectors. A first fuel injector can be dismounted from the casing and withdrawn therefrom through the aperture of a dismounted second fuel injector.

5 Claims, 1 Drawing Sheet

FUEL INJECTOR MOUNTING SYSTEM

FIELD OF THE INVENTION

The present invention relates to a system for mounting fuel injectors to a gas turbine engine.

BACKGROUND OF THE INVENTION

Fuel is delivered to the combustion chamber(s) of a gas turbine engine by one or more fuel injectors.

Fuel injectors for aircraft gas turbine engines are often mounted externally of a casing of the combustion chamber at respective apertures through the casing. Each injector has a mounting flange which is sealingly connected to the external surface of the casing with a feed arm and tip of the injector passing through the aperture and the tip engaging into the head of the combustion chamber. Bolts secure the flange via threads in the casing.

However, a problem with this arrangement is that the securing bolts are working against the casing internal pressure. More particularly, the pressure difference across the casing may be in the range from about 35 to 4100 kPa, with the high pressure within the casing forcing the injector flange away from the casing. This can cause air leakage, and hence engine efficiency loss. On the other hand, an advantage of the arrangement is that the injector can be removed on-wing for maintenance or replacement.

An alternative arrangement has the injector flange sealingly connected to the internal surface of the casing. This overcomes the air leakage problem because the sealing arrangement is working with the internal pressure, ie the pressure difference across the casing forces the flange toward the casing. However, the internally mounted injector cannot be easily removed as the flange is too large to be withdrawn through the aperture. Thus the injector can only be removed from the inside, which requires a major engine strip, rendering on-wing maintenance or replacement effectively impossible.

Thus there is a need to provide a system for mounting fuel injectors to a gas turbine engine which facilitates on-wing removal of the injectors while reducing air leakage.

SUMMARY OF THE INVENTION

Accordingly, a first aspect of the present invention provides a system for mounting fuel injectors to a gas turbine engine, the system comprising:

- an engine casing having a plurality of apertures formed therein, and
- a plurality of first and second fuel injectors, each fuel injector having a respective flange for mounting the fuel injector to the casing at a respective aperture so that the fuel injector extends into the engine, the first fuel injectors having flanges which are dismountably sealed to an inner side of the casing, and the second fuel injectors having flanges which are dismountably sealed to an outer side of the casing;
- wherein the flanges of the first fuel injectors are configured to allow them to pass through the apertures of the second fuel injectors, so that a first fuel injector can be dismounted from the casing and withdrawn therefrom through the aperture of a dismounted second fuel injector.

With the exception of fluid (eg fuel) flow through the injector, the flange of a particular fuel injector can close off the respective aperture. Advantageously, the system combines an internal mounting arrangement for the first injectors, which can reduce overall air leakage relative to an engine having all externally mounted injectors, with an ability to withdraw the first injectors through the apertures of the second injectors, which facilitates on-wing removal of all the injectors.

The system may have any one or, to the extent that they are compatible, any combination of the following optional features.

Typically, the fuel injector is a fuel spray nozzle, such as an air spray nozzle. Typically, the apertures of the first fuel injectors are smaller than the apertures of the second fuel injectors.

Preferably, at least half, and more preferably at least two thirds, of the first and second fuel injectors are first fuel injectors.

The fuel injectors may be circumferentially spaced around the casing, for example with each second fuel injector having first fuel injectors as nearest neighbours.

A further aspect of the invention provides an engine casing of the first aspect.

BRIEF DESCRIPTION OF THE DRAWINGS

Embodiments of the invention will now be described by way of example with reference to the accompanying drawings in which.

DETAILED DESCRIPTION

Figure 1:
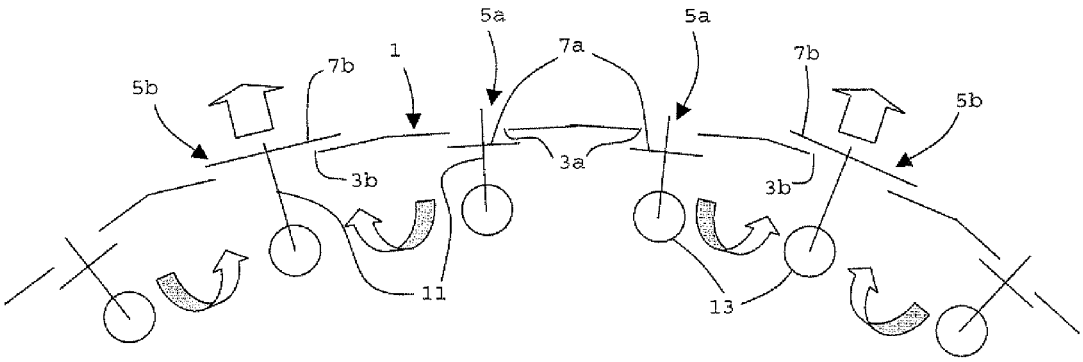
FIG. 1 shows a schematic diagram of a system for mounting fuel injectors to a gas turbine engine according to the present invention.
Figure 2:
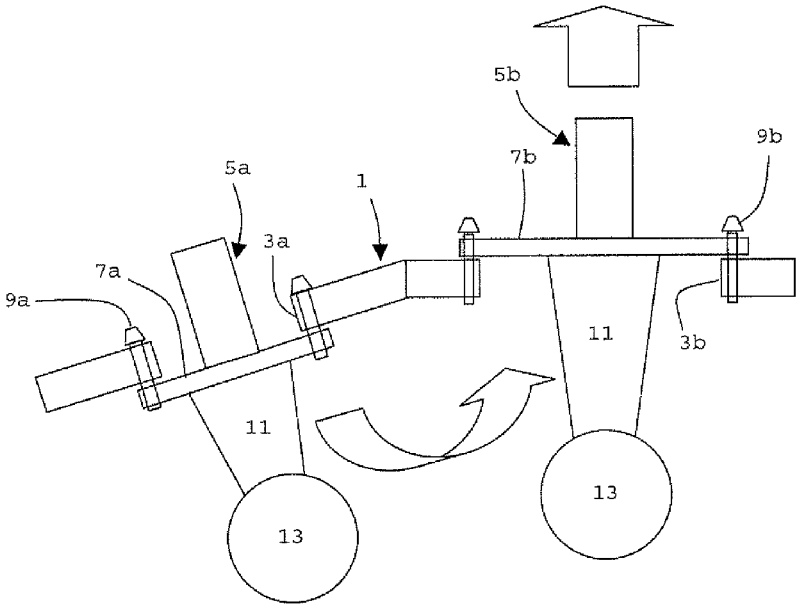
FIG. 2 shows a close up schematic view of two adjacent fuel injectors in the system of FIG. 1.

FIG. 1 shows a schematic diagram of a system for mounting fuel injectors to a gas turbine engine according to the present invention. FIG. 2 shows a close up schematic view of two adjacent fuel injectors in the system of FIG. 1.

An engine casing 1 has a plurality of circumferentially spaced, essentially circular apertures 3*a*, 3*b*. Each aperture 3*a* is the mounting position for a first fuel injector 5*a* and each aperture 3*b* is the mounting position for a second fuel injector 5*b*. The fuel injectors 5*a* and 5*b* are shown as fuel spray nozzles.

Each first nozzle 5*a* has a circular flange 7*a* whose diameter is greater than that of the respective aperture 3*a*. To mount the first nozzle to the casing, the first nozzle is positioned within the casing. A set of bolts 9*a* sealingly fastens the flange to an inner side of the casing.

Likewise, each second nozzle 5*b* has a circular flange 7*b* whose diameter is greater than that of the respective aperture 3*b*. However, to mount the second nozzle to the casing, the second nozzle is positioned outside the casing. A set of bolts 9*b* sealingly fastens the flange to an outer side of the casing.

The heads of both sets of bolts 9*a*, 9*b* face outwardly, allowing the bolts to be fastened and unfastened from the outside of the casing.

The feed arms 11 and tips 13 of both the first 5*a* and second 5*b* nozzles extend from the respective aperture 3*a*, 3*b* into the engine so that each tip engages with the head of a combustion chamber.

Significantly, the diameters of the apertures 3*b* are greater than the diameters of the flanges 7*a*. When the externally mounted second nozzles 5*b* are dismounted, this allows the adjacent internally mounted first nozzles 5*a* to be dismounted and withdrawn through the apertures 3*b*, as indicated by the arrows in FIGS. 1 and 2. The procedure allows the first nozzles 5*a* to be removed while the engine remains on-wing. The first nozzles 5*a* can be remounted by returning them through the apertures 3*b*, although at engine build the first nozzles 5*a* may be fitted from inside the casing 1.

Suitably configured tools can facilitate the dismounting operation of the first nozzles 5*a*. For example, a nozzle tool can be screwed into an inlet thread of nozzle 5*a*, allowing the nozzle to be securely held from outside the casing when the corresponding bolts 9*a* are unfastened and facilitating the manoeuvring of the nozzle towards the adjacent aperture 3*b*.

By reducing the number of externally mounted nozzles, the system can significantly reduce the overall leakage flow from the nozzle/casing interfaces, which can benefit is engine efficiency, and reduce temperatures outside the casing 1. In particular, the internally mounted first nozzles 5*a* use the high internal pressure within the casing to help seal the flanges 7*a* to the casing.

in the system shown in FIGS. 1 and 2, two thirds of the nozzles are internally mounted first nozzles 5*a* which provide the improved sealing, ie there are six equispaced externally mounted second nozzles 5*b* and twelve first nozzles 5*a*, each first nozzle being a nearest neighbour of a second nozzle. However, it is possible to provide a greater number of first nozzles. The possible combinations and patterns of internal and external nozzles will depend on the total number of nozzles, engine geometry etc. For example, in an engine with twenty nozzles it may be possible to use four equispaced second nozzles and sixteen first nozzles, half of the first nozzles being nearest neighbours of a second nozzle, and half of the first nozzles being at one remove from a second nozzle.

The invention claimed is:

1. A system for mounting fuel injectors to a gas turbine engine, the system comprising an engine casing having a plurality of apertures formed therein, and a plurality of first and second fuel injectors, each fuel injector having a respective flange for mounting the fuel injector to the engine casing at a respective aperture so that the fuel injector extends into the gas turbine engine, the first fuel injectors having flanges which are dismountably sealed to an inner side of the engine casing, and the second fuel injectors having flanges which are dismountably sealed to an outer side of the engine casing wherein the flanges of the first fuel injectors are configured to allow the first fuel injectors to pass through the apertures of the second fuel injectors, so that a first fuel injector can be dismounted from the engine casing and withdrawn therefrom through the aperture of a dismounted second fuel injector.

2. A system according to claim 1 wherein the apertures of the first fuel injectors are smaller than the apertures of the second fuel injectors.

3. A system according to claim 1 wherein at least half of the first and second fuel injectors are first fuel injectors.

4. A system according to claim 1 wherein the fuel injectors are circumferentially spaced around the engine casing and each second fuel injector has first fuel injectors as nearest neighbours.

5. An engine casing as claimed in claim 1.

* * * * *